United States Patent [19]

Lessard et al.

[11] Patent Number: 4,718,241

[45] Date of Patent: Jan. 12, 1988

[54] CRYOPUMP WITH QUICKER ADSORPTION

[75] Inventors: Philip A. Lessard; Bruce R. Andeen, both of Acton, Mass.

[73] Assignee: Helix Technology Corporation, Waltham, Mass.

[21] Appl. No.: 52,137

[22] Filed: Apr. 28, 1987

Related U.S. Application Data

[63] Continuation of Ser. No. 793,707, Oct. 31, 1985, abandoned.

[51] Int. Cl.[4] ..... B01D 8/00

[52] U.S. Cl. ..... 62/55.5; 55/269; 62/268; 417/901

[58] Field of Search ..... 62/55.5, 100, 268; 55/269; 417/901

[56] References Cited

U.S. PATENT DOCUMENTS

| | | | |
|---|---|---|---|
| 4,295,338 | 10/1981 | Welch | 62/55.5 |
| 4,336,690 | 6/1982 | Welch | 62/55.5 |
| 4,356,701 | 1/1985 | Bartlett et al. | 62/55.5 |
| 4,485,631 | 12/1984 | Winkler | 62/55.5 |
| 4,494,381 | 1/1985 | Lessard | 62/55.5 |
| 4,546,613 | 10/1985 | Eacobacci et al. | 62/55.5 |
| 4,555,907 | 12/1985 | Bartlett | 62/55.5 |

FOREIGN PATENT DOCUMENTS

| | | |
|---|---|---|
| 126909 | 12/1984 | European Pat. Off. . |
| 85/05410 | 12/1985 | European Pat. Off. . |
| 2229655 | 12/1973 | Fed. Rep. of Germany . |
| 2455712 | 8/1976 | Fed. Rep. of Germany . |
| 652804 | 11/1985 | Switzerland . |

*Primary Examiner*—Ronald C. Capossela

*Attorney, Agent, or Firm*—Hamilton, Brook, Smith & Reynolds

[57] ABSTRACT

A cryopump with quicker adsorption of non-condensible gases is disclosed. The second stage cryopanel of this cryopump is comprised of an array of discs spaced along an axis perpendicular to the frontal cryopanel, and in close thermal contact with the second stage heat sink. Each disc of the array is bent toward the frontal cryopanel at the outer edge of the disc and is flat radially inward from the bend. Each disc is coated with adsorbent material on the surface away from the frontal cryopanel radially inward from the bend in the disc.

10 Claims, 3 Drawing Figures

CRYOPUMP WITH QUICKER ADSORPTION

This is a continuation of co-pending application Ser. No. 793,707 filed on Oct. 31, 1985 now abandoned.

DESCRIPTION

1. Technical Field

This invention relates to cryopumps and has particular application to cryopumps cooled by two stage closed cycle coolers.

2. Background

Cryopumps currently available, whether cooled by open or closed cyrogenic cycles, generally follow the same design concept. A low temperature second stage array, usually operating in the range of 4°-25° K., is a primary pumping surface. This surface is surrounded by a high temperature cylinder usually operated in the temperature range of 40°-130° K., which provides radiation shielding to the lower temperature array. The radiation shield generally comprises a housing which is closed except at a frontal array positioned between the primary pumping surface and the chamber to be evacuated. This higher temperature, first stage, frontal array serves as a pumping site for high boiling point gases such as water vapor.

In operation, high boiling point gases such as water vapor are condensed on the frontal array. Lower boiling point gases pass through the frontal array and into the volume within the radiation shield and condense on the second stage array.

These inner surfaces may be coated with an adsorbent such as charcoal or zeolite to adsorb low temperature non-condensing gases such as hydrogen, helium or neon. Adsorption is a process whereby gases are physically captured by a material held at cryogenic temperatures and thereby removed from the environment. With the gases thus condensed or adsorbed onto the pumping surfaces, only a vacuum remains in the work chamber.

In systems cooled by closed cycle coolers, the cooler is typically a two stage refrigerator having a cold finger which extends through the radiation shield. The cold end of the second, coldest stage of the refrigerator is at the tip of the cold finger. The primary pumping surface, or cryopanel, is connected to a heat sink at the coldest end of the second stage of the cold finger. This cryopanel may be a simple metal plate, a cup or a cylindrical array of metal baffles arranged around and connected to the second stage heat sink as, for example, in U.S. Pat. No. 4,494,381. This second stage cryopanel may also support low temperature condensing gas adsorbents such as charcoal or zeolite as previously stated.

The radiation shield is connected to a heat sink, or heat station, at the coldest end of the first stage of the refrigerator. This shield surrounds the first stage cryopanel in such a way as to protect it from radiant heat. The frontal array which closes the radiation shield is cooled by the first stage heat sink through the shield or, as disclosed in U.S. Pat. No. 4,356,701, through thermal struts.

In most conventional cryopumps, the refrigerator cold finger extends through the base of a cup-like radiation shield and is concentric with the shield. In other systems, the cold finger extends through the side of the radiation shield. Such a configuration at times better fits the space available for placement of the cryopump.

Cryopumps need to be regenerated from time to time after large amounts of gas have been collected; otherwise they become inefficient. Regeneration is a process wherein gases previously captured by the cryopump are released. Regeneration is usually accomplished by allowing the cryopump to return to ambient temperatures and the gases are then removed from the cryopump by means of a secondary pumping means. Following this release and removal of gas, the cryopump is turned back on and after re-cooling is again capable of removing large amounts of gas from a work chamber.

The practice of the prior art has been to protect the adsorbent material placed on the second stage cryopanel, e.g. by enclosing the second stage adsorbent with chevrons, to prevent condensing gases from condensing on and hence blocking the adsorbent layer. In this manner, the layer is saved for the adsorption of noncondensing gases such as hydrogen, neon, or helium. This reduces the frequency of regeneration cycles. The chevrons, however, decrease the accessibility of the noncondensables to the adsorbent.

SUMMARY OF THE INVENTION

The present invention increases the speed for pumping the non-condensable gases, while at the same time limiting the frequency of regeneration of the system. It accomplishes this by opening up the second stage cryopanel to allow greater accessibility of the noncondensing gases, such as hydrogen, neon, or helium, to the adsorbent material which has been placed on the interior surfaces of the discs of the secondary cryopanel. This allows the noncondensing gases to be adsorbed more quickly, thus increasing the pumping speed for the non-condensables. At the same time, the second stage array is so designed so as to assure that all of the gas molecules first strike a surface of the cryopanel which has not been coated with an adsorbent material.

A cryopump incorporating the principles of this invention comprises a multi-stage refrigerator and cryopanels mounted to low temperature heat sinks on the refrigerator. The lowest temperature cryopanel is the second stage cryopanel. It comprises an array of discs based along an axis perpendicular to the frontal cryopanel. Furthermore, the second stage cryopanel is in thermal contact with the second stage heat sink. Each disc of the array is bent toward the frontal cryopanel at the outer edge of the disc and each disc is flat radially inward from the bend. The surface away from the frontal cryopanel radially inward from the bend in the disc is coated with adsorbent material.

In a preferred embodiment, the discs in the second stage cryopanel are bent at 45 degree angles toward the frontal cryopanel. The outermost edge of each disc is at about the same height as the flat portion of the next disc which lies proximate to the frontal cryopanel. The discs may be of varied diameters such that the discs are progressively smaller approaching the frontal cryopanel.

BRIEF DESCRIPTION OF THE DRAWINGS

The foregoing and other objects, features and advantages of the invention will be apparent from the following, more particular description of preferred embodiments of the invention, as illustrated in the accompanying drawings in which like referenced characters refer to the same parts throughout the different views. The drawings are not necessarily to scale, emphasis instead being placed on and illustrating the principles of the drawings.

DESCRIPTION OF PREFERRED EMBODIMENTS

Figure 1:
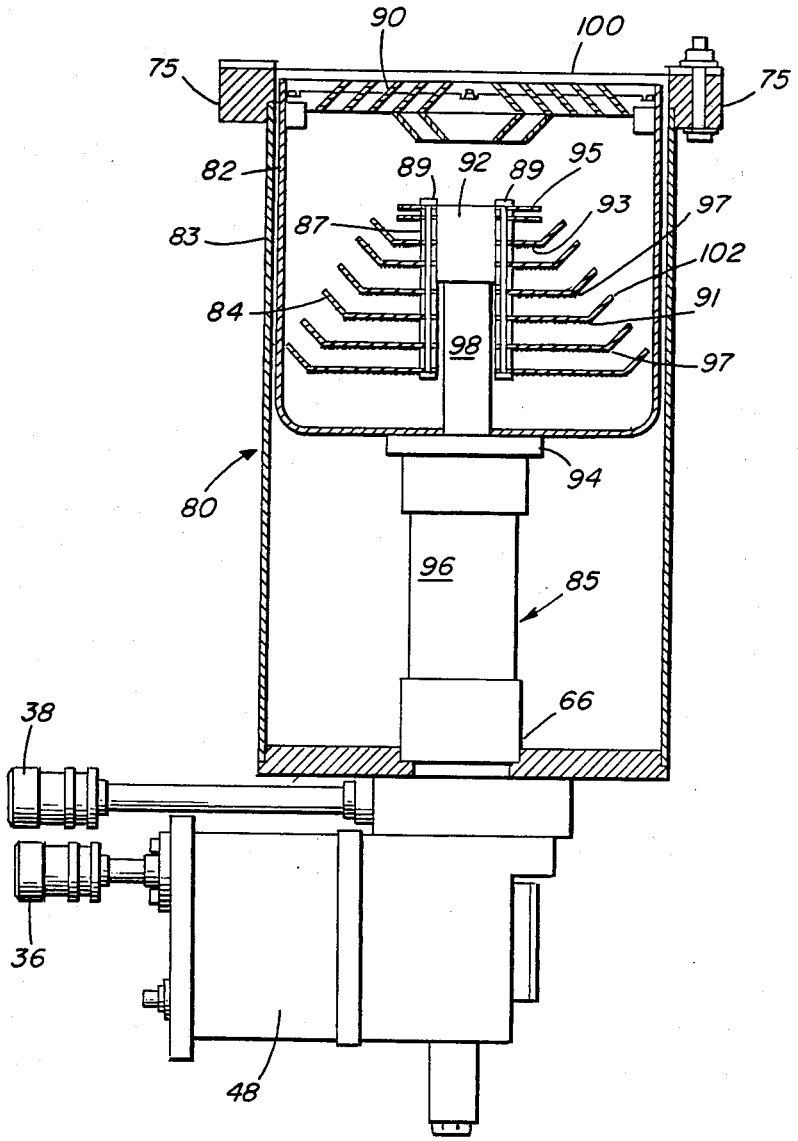
FIG. 1 is a cross section of one embodiment of the invention.

FIG. 1 is a cross sectional view of a cryopump incorporating the principles of this invention.

A cryopump 80 in FIG. 1 comprises a main cryopump housing 83 which may be mounted directly to a work chamber on flange 75 or to an intermediate gate valve between it and the work chamber. A two stage cold finger 85 of a cryogenic refrigerator protrudes into the housing through opening 66. In this case, the refrigerator is a Gifford-MacMahon cycle refrigerator but others may be used.

The refrigerator includes a displacer in the cold finger 85 which is driven by a motor 48. Helium gas is introduced to and removed from the cold finger 85 by lines 38 and 36. Helium gas entering the cold finger is expanded by the displacer and thus cooled in a manner which produces very cold temperatures. Such a refrigerator is disclosed in U.S. Pat. No. 3,218,815 to Chellis et al.

A first stage pumping surface 90 is mounted to a cold end heat sink 94 of a first stage 96 of the refrigerator 85 through a radiation shield 82.

The cup-shaped radiation shield 82 mounted to the first stage heat sink 94 operates at about 77 degrees Kelvin. The radiation shield surrounds the second stage cryopumping area and minimizes the heating of that area by direct radiation or by higher condensing temperature vapors. The first stage pumping surface comprises a frontal chevron array 90 which serves as both a radiation shield for the second stage pumping area and a cryopumping surface for higher temperature condensing gases such as water vapor. The frontal chevron array 90 shown here is a typical configuration but the frontal array may be constructed in several different ways and still be effective in the collection of higher temperature condensing gases. This chevron array allows the passage of lower condensation temperature gases through to the second stage pumping area.

The second stage cryopanel 84 comprises an array of discs attached to rods 89 which run parallel to the second stage 98 of the refrigerator and are attached to the second stage heat sink 92. Spacers 87 may also be used to support and separate adjacent discs from each other. The rods are usually 90 degrees apart from each other about the circumference of the disc.

Each disc has a single peripheral bend 91 by which the rim of the disc is directed toward the frontal array. For best results, the bend is at about 45°.

Adsorbent material 93, usually charcoal or zeolite, is attached to the flat surfaces of the discs away from the frontal cryopanel radially inward from the bends in the discs 91. If a greater amount of adsorbent is required, the adsorbent can also be epoxied to the upper surfaces of both the flat regions and the frustoconical rims 84, but such adsorbent is not as well protected from contamination.

The outermost edge 102 of each disc of the second stage cryopanel is preferably at the same height as the flat surface 97 of the next disc proximate to the frontal cryopanel 90. The discs of the array of the secondary cryopanel are of varied diameters such that the discs are progressively smaller approaching the frontal cryopanel.

The array of discs of the secondary cryopanel is so designed as to allow ample opportunity for the condensable gases to condense on surfaces which are not coated with adsorbent material. At the same time the discs are open to molecular flow from within the radiation shield to promote the rapid adsorption of the non-condensable gases onto the adsorbent material.

Gas molecules in low pressure environments travel along straight paths and, as they hit a surface, are most likely to be reflected from the surface according to the cosine law. The second stage cryopanel is designed to take advantage of these phenomena. A condensable gas molecule which hits the cold surface of one of the discs condenses onto that surface after only one hit. However, if a molecule of non-condensable gas hits a portion of the surface of a disc which has not been coated with adsorbent material, the array of discs is so designed so as to make it more likely than not that the molecule of non-condensable gas will bounce off of that surface at a 90° angle relative to that surface onto a surface of a disc which has been coated with adsorbent material. A non-condensable gas molecule with greatest probability only hits a non adsorbent-coated surface of the array once before it hits a surface which has been coated with adsorbent material where it is adsorbed. The minimal extent to which gases strike non-adsorbing surfaces decreases the molecular path length to the adsorbent and thus greatly increases the rate of non-condensable gas adsorption. This in turn increases the rate at which the system pumps.

There are several features incorporated into the design of the array of discs which promote this result. These features include the following.

(1) The 45° bend at the end of each disc 91 directs noncondensing gas toward the adsorbent.

(2) The outermost edge of each disc 102, FIG. 1, is at about the same height as the flat portion 97 of the next disc which lies proximate to the frontal panel. Thus, the array is optically opaque with respect to the adsorbent so the adsorbent is substantially protected by low temperature condensing surfaces. On the other hand, the outer rim of each disc does not extend so far as to create an extended channel in which the non-condensing gas might be temporarily captured with multiple reflections.

(3) The discs are flat, radially inward from the outer bend in the disc, to minimize the path length to the adsorbent.

(4) The discs of the array are progressively smaller as they approach a frontal cryopanel. As a result, the angled rims of the several discs are highly visible from the frontal array so that molecules moving from the frontal array to the second stage are likely to be promptly captured by those rims or deflected toward the adsorbent.

All of the above-mentioned design features of the array of discs promote the reflection of non-condensable gas molecules toward the adsorbent coated surfaces of the interior of the cryopanel. The design of the array also makes it virtually impossible for a molecule of gas to hit the protected adsorbent-coated portion of a disc before first striking another portion of a disc. It has been found that so long as each molecule strikes a non-coated portion almost total condensation of the condensable gases onto non-coated portions of the discs is promoted, thus limiting the frequency of regeneration.

Figure 2:
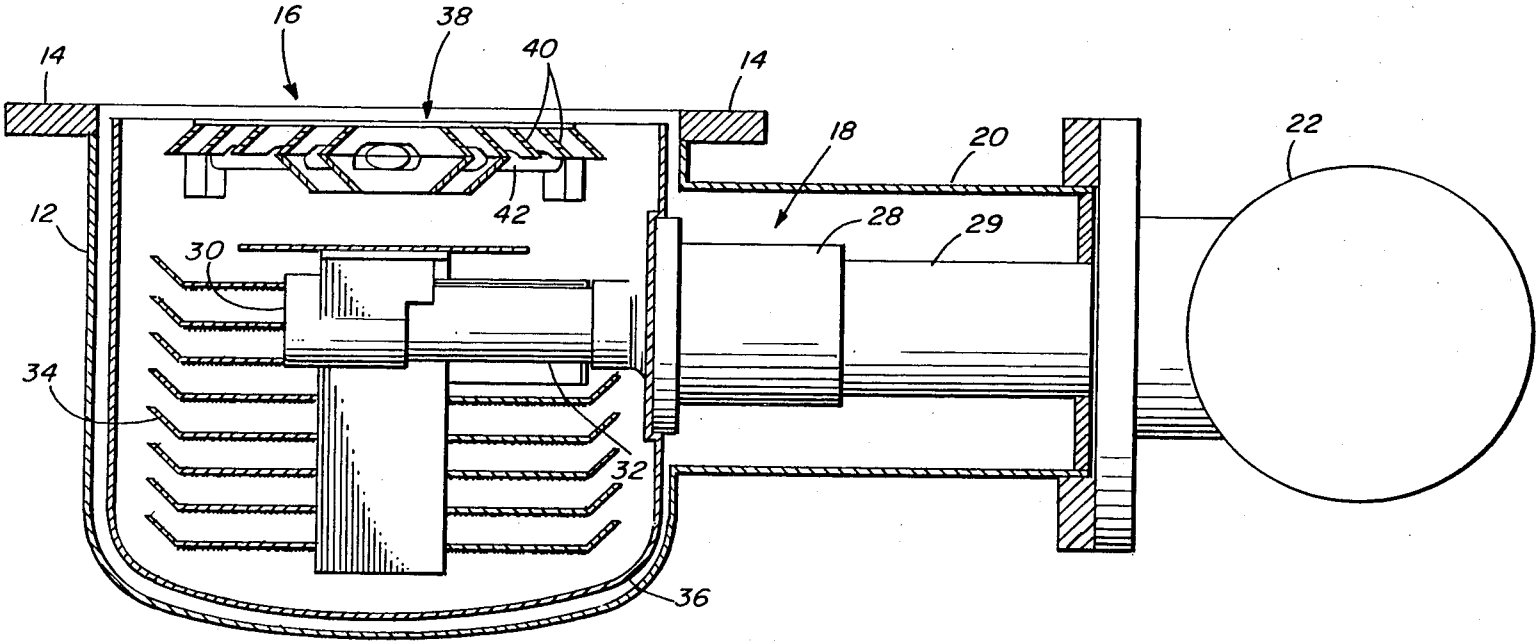
FIG. 2 is a longitudinal, cross sectional view of another embodiment of the present invention.

The alternative cryopump of FIG. 2 comprises a vacuum vessel 12 which may be mounted to the wall of a work chamber along a flange 14. The front opening 16 in the vessel 12 communicates with a circular opening in a work chamber. A two stage cold finger 18 of a refrigerator protrudes into the vessel 12 through a cylindrical portion 20 of the vessel 12. A two stage displacer in the cold finger 18 is driven by a motor 22. A first stage heat sink, or heat station 28 is mounted at the cold end of the first stage 29 of the refrigerator. Similarly, a heat sink 30 is mounted to the cold end of the second stage 32.

The primary pumping surface is an array of discs 34 mounted to the second stage heat station 30. This array is preferably held at a temperature below 20 degrees Kelvin in order to condense low condensing temperature gases and adsorb non-condensing gases. A cup-shaped radiation shield 36 is mounted to the first stage heat sink 28. The second stage 32 of the cold finger extends through an opening in the radiation shield. This shield surrounds the second stage array 34 to the rear and side of the array to minimize heating of the array by radiation. Preferably, the temperature of this radiation shield is less than about 100 degrees Kelvin.

A frontal array 38 serves as both the radiation shield for the primary cryopanel 34 and as a cryopumping surface for higher boiling temperature gases such as water vapor. This array comprises louvers 40 joined by radial support rods 42. The support rods are mounted to the radiation shield 36. The shield both supports a frontal array and serves as the thermal path from the array to the heat sink.

Figure 3:
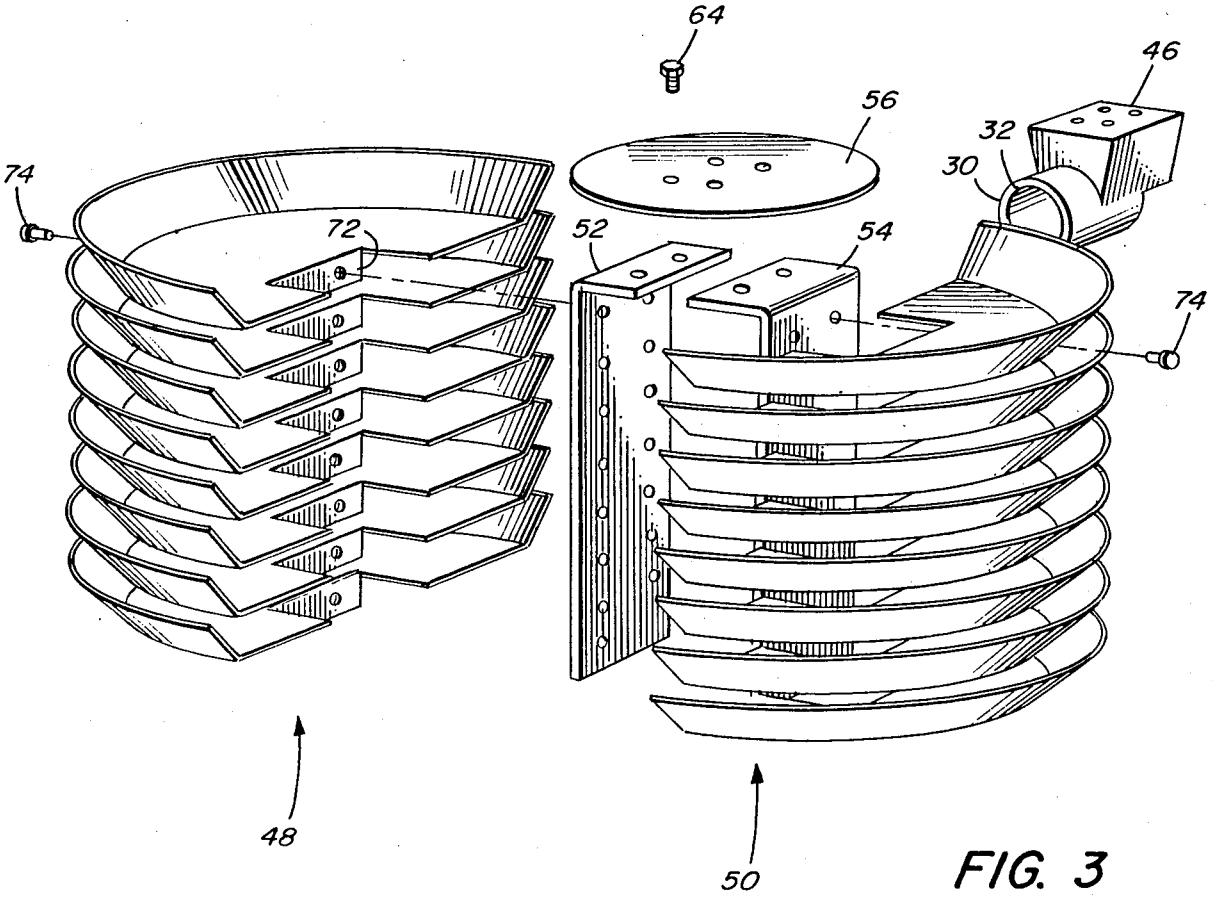
FIG. 3 is a composite drawing of the second stage array of the embodiment portrayed in FIG. 2.

As shown in FIG. 3, the array of discs of the secondary cryopanel of the embodiment shown in FIG. 2 is formed of two separate groups of semi-circular disc sections 48 and 50 mounted to respective brackets 52 and 54 which are in turn mounted to the flat surface 46 of the heat station 30. Each bracket is a flat L-shaped bar. They extend transverse to the cold finger 32 on opposite sides of the heat station 30. The discs, unlike those of the embodiment depicted in FIG. 1, are of the same diameter. For a better illustration of these features see U.S. Pat. No. 4,555,907. The discs are bent at a 45 degree angle towards the frontal cryopanel 38 in FIG. 2.

While the invention has been particularly shown and described with reference to preferred embodiments thereof, it will be understood by those skilled in the art that various changes in form and details may be made therein without departing from the spirit and scope of the invention as defined by the appended claims.

We claim:

1. A cryopump which comprises:

a refrigerator having first and second stages;

a second stage cryopanel in thermal contact with a heat sink on the second stage of the refrigerator to condense low temperature condensing gases;

a radiation shield surrounding the second stage cryopanel and in thermal contact with a first stage heat sink, and a frontal cryopanel across an opening in the radiation shield serving as a radiation shield for the second stage cryopanel and as a cryopumping surface for higher condensing temperature gases;

the second stage cryopanel comprising an array of discs spaced along an axis perpendicular to the frontal cryopanel, and in close thermal contact with the second stage heat sink, each disc of the array being bent toward the frontal cryopanel at the outer edge of the disc, being flat radially inward from the bend, and being coated with adsorbent material on the surface away from the frontal cryopanel radially inward from the bend in the disc, the outermost edge of each disc being at about the same height as the flat portion of the next disc which lies proximate to the frontal cryopanel.

2. A cryopump as cited in claim 1 wherein the array of discs of the second stage cryopanel is attached to support elements.

3. A cryopump as cited in claim 2 wherein the support elements are rods.

4. A cryopump as cited in claim 2 wherein the support elements are brackets.

5. A cyropump as cited in claim 1 where the discs in the second stage cryopanel are bent at 45 degree angles towards the frontal cyropanel.

6. A cryopump as cited in claim 1 wherein the discs are of varied diameters such that the discs are progressively smaller approaching the frontal cryopanel.

7. A cryopump as cited in claim 1, wherein each disk comprises two sections independently mounted to brackets which are mounted to the second stage of the refrigerator.

8. A cryopump which comprises:

a refrigerator having first and second stages;

a second stage cryopanel in thermal contact with a heat sink on the second stage of the refrigerator to condense low temperature condensing gases; and a radiation shield surrounding the second stage cryopanel and in thermal contact with a first stage heat sink, and a frontal cryopanel across an opening in the radiation shield serving as a radiation shield for the primary cryopanel and as a cryopumping surface for higher condensing temperature gases;

the second stage cryopanel comprising an array of discs, said discs being attached to support elements, and said discs being spaced along an axis perpendicular to the frontal cryopanel, and in close thermal contact with the second stage heat sink, each disc of the array being bent toward the frontal cryopanel at a 45 degree angle at the outer edge of the disc and being flat radially inward from the bend, the outermost edge of each disc being at about the same height as the flat portion of the next disc proximate to the frontal cryopanel, and the disc being coated with adsorbent material on the surface away from the frontal cryopanel radially inward from the bend in the disc.

9. A cryopump as cited in claim 8 wherein the discs of the second stage cryopanel are of varied diameter such that the discs are progressively smaller approaching the frontal cryopanel.

10. A cryopump which comprises:

a refrigerator having first and second stages;

a second stage cryopanel in thermal contact with a heat sink on the second stage of the refrigerator to condense low temperature condensing gases; and a radiation shield surrounding the second stage cryopanel and in thermal contact with a first stage heat sink, the radiation shield having a frontal opening;

the second stage cryopanel comprising an array of discs spaced along an axis which is substantially directed toward the frontal opening, and in close thermal contact with the second stage heat sink, each disc of the array being bent toward the frontal opening at the outer edge of the disc, being flat radially inward from the bend, and being coated with adsorbent material on the surface away from the frontal opening radially inward from the bend in the disc, the outermost edge of each disc being at about the same height as the flat portion of the next disc which lies proximate to the frontal cryopanel.

* * * * *